US005477824A

United States Patent [19]

Reedy

[11] Patent Number: 5,477,824

[45] Date of Patent: Dec. 26, 1995

[54] SOLENOID VALVE FOR COMPRESSION-TYPE ENGINE RETARDER

[75] Inventor: Steven W. Reedy, Nashville, Ind.

[73] Assignee: Cummins Engine Company, Inc., Columbus, Ind.

[21] Appl. No.: 275,118

[22] Filed: Jul. 14, 1994

[51] Int. Cl.[6] ..... F02D 13/04

[52] U.S. Cl. ..... 123/322

[58] Field of Search ..... 123/322, 198 F, 123/321, 323, 320, 90.11, 90.12; 251/129; 137/620, 596.1, 596.16, 596.17, 596.18, 627.5, 557

[56] References Cited

U.S. PATENT DOCUMENTS

| | | | |
|---|---|---|---|
| 2,393,579 | 1/1946 | Weiss et al. | 123/322 |
| 2,944,565 | 7/1960 | Dahl | 137/620 |
| 3,220,392 | 11/1965 | Cummins | 123/321 |
| 3,332,405 | 7/1967 | Haviland | 123/321 |
| 3,921,666 | 11/1975 | Leiber | 137/596.1 |
| 3,982,507 | 9/1976 | Asaka et al. | 123/322 |
| 4,173,209 | 11/1979 | Jordan | 123/322 |
| 4,175,534 | 11/1979 | Jordan | 123/198 F |
| 4,251,051 | 2/1981 | Quenneville et al. | 251/129 |
| 4,460,015 | 7/1984 | Burt et al. | 137/625.5 |
| 4,844,119 | 7/1989 | Martinic | 137/596.17 |
| 4,996,957 | 3/1991 | Meistrick | 123/90.16 |
| 5,379,737 | 1/1995 | Hu | 123/322 |

*Primary Examiner*—Raymond A. Nelli
*Attorney, Agent, or Firm*—Woodard, Emhardt, Naughton Moriarty & McNett

[57] ABSTRACT

A solenoid valve for use with a solenoid as park of an engine retarder braking system includes a valve body arranged with a plurality of apertures and which receives an upper check valve pin, a lower check valve pin, and a biasing spring which acts on both check valve pins. The solenoid includes a coil and moveable armature and the braking system includes a high pressure circuit with a master piston and cylinder and a slave piston and cylinder. The two cylinders are connected by a flow passageway. The housing has a fluid inlet, a fluid outlet, and an access port. The fluid inlet receives low pressure oil which acts upon one side of the lower check valve pin. The opposite side of the lower check valve pin is acted upon by the fluid in the high pressure circuit and by the biasing spring. When the pressure difference allows the lower check valve pin to move out of its sealed position against the fluid inlet, oil is introduced into the high pressure circuit. When the upper check valve pin is sealed against the access port and the lower check valve pin is sealed against the fluid inlet, the high pressure circuit is sealed closed, allowing upward movement of the master piston to pressurize the oil in the circuit and create downward movement in the slave piston, which causes the corresponding exhaust valves to open.

18 Claims, 3 Drawing Sheets

SOLENOID VALVE FOR COMPRESSION-TYPE ENGINE RETARDER

BACKGROUND OF THE INVENTION

The present invention relates in general to engine brake retarders of the compression release type. More particularly, the present invention pertains to an improved hydraulic circuit solenoid valve which combines solenoid and control valve functions into a single component.

Engine brake retarders of the compression release type are believed to be well known in the art. These devices may be referred to as an engine brake or engine retarder, but regardless of the name, the theory of operation is basically the same. In general, such engine retarders are designed to control the motion of a slave piston which opens the exhaust valves of an internal combustion engine cylinder near the end of the compression stroke. As a result, the work done in compressing the intake air is not recovered during the expansion stroke, but rather is dissipated through the exhaust (and cooling) systems of the engine.

One current style of engine retarder is represented by the Cummins Engine C Brake which is offered by Cummins Engine Company, Inc., of Columbus, Ind. The C Brake is a highly efficient engine retarder which is used for reducing vehicle speed. The theory of operation, which is similar in certain respects to other engine retarder designs, uses a hydraulic circuit that opens the exhaust valve(s) near the end of the compression stroke. When the C Brake is activated and the vehicle is moving, the engine produces a compression braking effect.

The C Brake uses one solenoid valve for each pair of engine cylinders in combination with two control valves, one for each cylinder. These components are assembled into a housing which is mounted directly on top of the rocker housing. When the solenoid valve is energized, engine oil enters the C Brake system through the rocker arm pedestal. As engine oil flows into the C Brake, the control valve is forced in an upward direction. A minimum of 18 psi is required to open this control valve. When the cross drilling in the control valve is aligned with the high pressure drilling, oil flows past a check ball into the master piston and slave piston high pressure circuit. This entering oil added pressure causes the master piston and slave piston to move in a downward direction.

As the injector push rod begins its upward travel, the injector rocker arm adjusting screw begins to force the master piston in an upward direction. This action closes the control valve check ball and as a result, oil is then trapped in the high pressure circuit. The continuing upward movement of the injector push rod increases the oil pressure and ultimately forces the slave piston to travel in a downward direction. With this advancing travel in a downward direction by the slave piston, it applies force to the cross head of the exhaust valves, forcing those valves to open. The opening of the exhaust valves allows compressed air to escape from the corresponding cylinder and thus a compression braking cycle has been completed. At the completion of this cycle, the injector push rod and master piston travel in a downward direction and this allows the oil pressure in the high pressure circuit to return to normal. Immediately, the slave piston moves in an upward direction, allowing the exhaust valves to close. Any leakage from the high pressure circuit is made up at this time by engine oil which enters through the solenoid valve and check valve within the control valve.

When the solenoid is de-energized, oil in the C Brake is returned to the engine. This allows the C Brake to be returned to its de-activated position and the master and slave pistons are retracted by spring pressure. As a result, these pistons are moved out of the way of normal engine operation.

One of the design realities with this type of engine retarder is the use of a control valve, one for each cylinder, which uses a control spring. Such springs have had, on occasion, reliability concerns and the elimination of the control valve springs would obviously avoid such concerns. Another design reality is the size of the control valve and its required travel distance. This also influences the size of the assembly housing which is required. If the control valve function can be combined as part of a new solenoid valve design, then the size of the engine retarder can be reduced. The present invention provides such an improved design.

While the Cummins Engine C Brake design represents one engine retarder arrangement, there are other configurations which deserve consideration when reviewing the complexity of engine retarder systems. One example of another system which uses a solenoid in combination with a control valve is disclosed in U.S. Pat. No. 4,996,957 which issued Mar. 5, 1991, to Meistrick. The disclosed device of Meistrick includes a first flow network for the delivery of oil at low pressure to a solenoid valve and from there to a control valve. Oil also fills the chambers of a slave cylinder and master cylinder. During a retarding event, the master piston moves upwardly in the cylinder in response to the motion of a push tube, creating a high pressure force which in turn forces the slave piston to move in a downward direction. The corresponding movement of the slave piston in a downward direction opens the exhaust valves near the end of the compression stroke of the engine.

As will be appreciated, the Meistrick device includes a number of components and controls including a specific control valve for the high pressure fluid circuit. There are also two flows which have to be managed by the controls and valves, including a low pressure oil delivery flow (and fill) and a high pressure, valve-opening flow. The result of this complexity is a significant size requirement and thus a need for a significant area or space in which to mount all of the required hardware and all in the vicinity of the cylinder exhaust valves.

It would be an improvement to the complexity of designs such as that described in the Meistrick patent if a single solenoid component could be designed to combine both the solenoid and control valve functions into one item. Ideally this would permit a smaller package size for the engine brake. Added benefits of such an improvement would be a reduction in the machining required to create the now-required control valve and solenoid drillings. If the currently used control valve can be eliminated by a combined solenoid design, then the now-required control valve spring could also be eliminated. Since the control valve springs have historically presented certain problems with regard to reliability, elimination of this spring would represent a substantial benefit to the engine brake in terms of improved reliability.

The present invention provides the aforementioned type of design improvement by a novel and unobvious solenoid valve which combines the solenoid and control valve functions into a single component. The result is a smaller package size and a design which handles both the low pressure flows as well as the high pressure flows.

In addition to what is disclosed in the Meistrick patent, there have been other solenoid and control valve arrangements invented over the years. The following listed patent references are believed to be a representative sampling of such earlier solenoid and control valve designs.

| PATENT NO. | PATENTEE | ISSUE DATE |
|---|---|---|
| 2,944,565 | Dahl | July 12, 1960 |
| 3,220,392 | Cummins | Nov. 30, 1965 |
| 3,332,405 | Haviland | July 25, 1967 |
| 3,921,666 | Leiber | Nov. 25, 1975 |
| 4,251,051 | Quenneville et al. | Feb. 17, 1981 |
| 4,460,015 | Burt et al. | July 17, 1984 |
| 4,844,119 | Martinic | July 4, 1989 |

While the handling of either low pressure flows or high pressure flows may be possible with one or more of the devices disclosed in the above list, nothing is disclosed which handles both by means of a single solenoid component as is provided by the present invention. For example, the Quenneville, et al., patent describes a solenoid which is used for controlling low pressure oil to an engine brake. In the Meistrick design the control function focuses on the high pressure circuit and not the low pressure supply side.

SUMMARY OF THE INVENTION

According to one embodiment of the present invention, a solenoid valve for use with a solenoid as part of an engine retarder braking system is disclosed. The cooperating solenoid which is used to actuate the solenoid valve includes a coil and a moveable armature. The braking system includes a high pressure circuit with a master piston disposed within a master cylinder, a slave piston disposed within a slave cylinder, and a flow passageway connecting the master cylinder with the slave cylinder. The solenoid valve which is combined with this system of other components comprises a housing arranged with the fluid inlet, a fluid outlet which is flow coupled to the flow passageway, and an armature access port. Additionally, an upper check valve pin is positioned within the housing and is designed to seal closed the armature access port. A lower check valve pin which is also positioned within the housing is disposed in axial alignment with the upper check valve pin and is designed to seal closed the fluid inlet. Both check valve pins are moveable between their sealed position and an open position. The solenoid valve further includes a biasing spring which is disposed within the housing and which is positioned relative to the upper and lower check valve pins so as to apply a separating spring force on those pins so as to bias those pins in opposite directions, apart from each other. When the solenoid armature is retracted, the upper check valve pin seals closed the access port and when the fluid pressure at the fluid inlet is sufficient to push the lower check valve pin out of sealed engagement fluid fills the high pressure circuit. With both check valve pins in a sealed condition, the fluid which is trapped in the high pressure circuit is acted on by movement of the master piston in order to control movement of the slave piston for opening of corresponding cylinder exhaust valves.

One object of the present invention is to provide an improved solenoid valve as part of an engine retarder braking system.

Related objects and advantages of the present invention will be apparent from the following description.

DESCRIPTION OF THE PREFERRED EMBODIMENT

Figure 1:
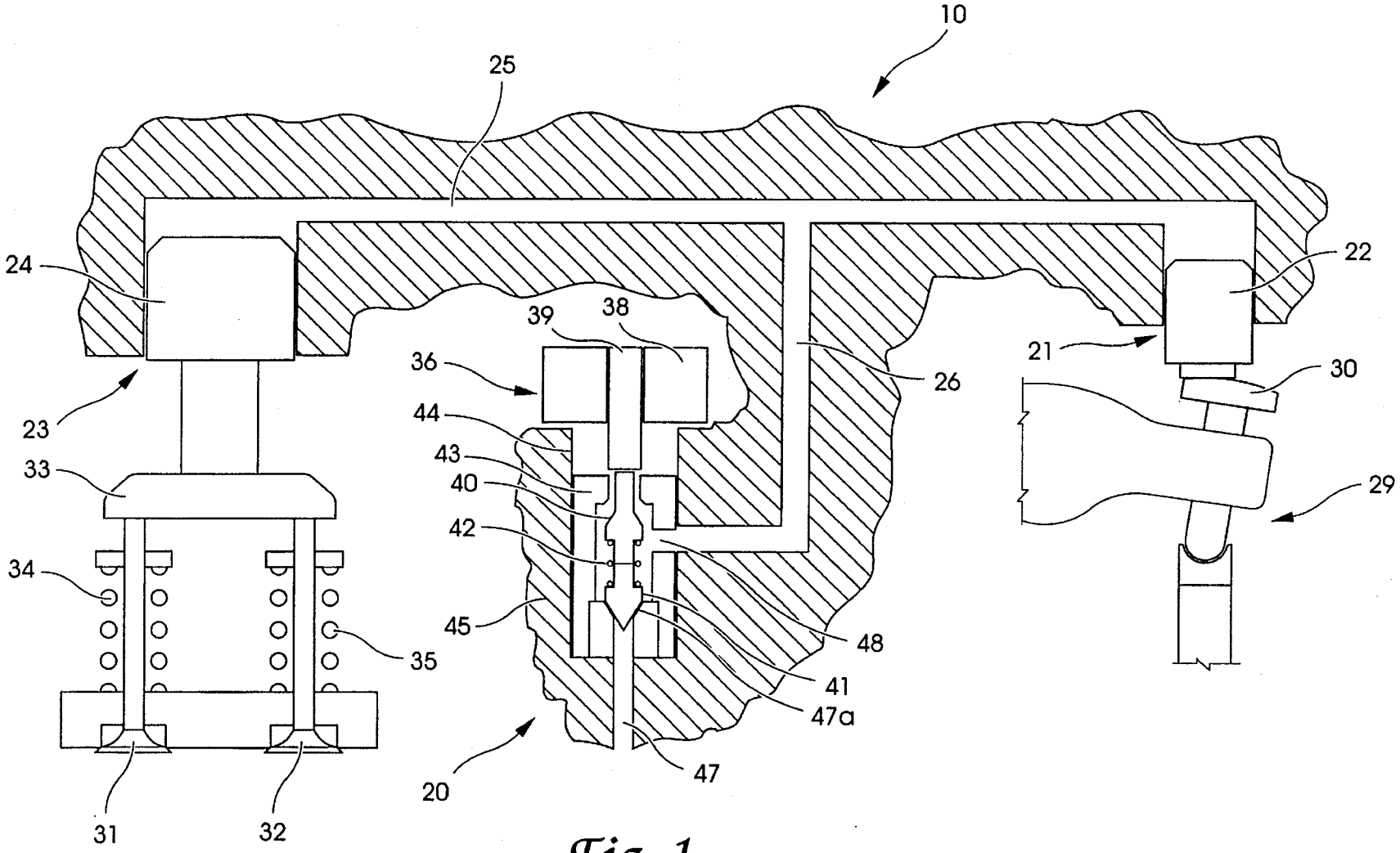
FIG. 1 is a diagrammatic illustration of an engine retarder braking system which includes an improved solenoid valve designed according to a typical embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIG. 1 there is illustrated an engine retarder braking system 10 which includes a novel solenoid valve 20 which is designed in accordance with the present invention. Solenoid valve 20 combines into a single unit the separate solenoid and control valve functions of earlier engine retarder designs. Illustrated as part of the FIG. 1 system are the masher cylinder 21 and master piston 22, properly assembled, and the slave cylinder 23 and slave piston 24, also properly assembled. These two assemblies are connected to each other (cylinder to cylinder) by oil passageway 25. Branch passageway 26 extends in flow communication between passageway 25 and solenoid valve 20. The master cylinder, slave cylinder and passageways 25 and 26 constitute a high pressure circuit. This circuit is actually able to function as a high pressure network when any oil escape passage or access through the solenoid valve 20 is blocked. Passageways 25 and 26 also provide the means for low pressure oil to fill cylinders 21 and 23.

Also illustrated in FIG. 1 is a diagrammatic representation of an injector push rod 29 in combination with a rocker arm adjusting screw 30 which contacts the lower face of the master piston 22. On the opposite side of FIG. 1 there is illustrated, as a diagrammatic representation, exhaust valves 31 and 32 whose action is controlled by crosshead 33 in combination with springs 34 and 35.

Solenoid 36 includes a coil 38 and an armature 39. The solenoid valve 20 includes upper check valve pin 40, lower check valve pin 41, and check valve biasing spring 42. The two check valve pins 40 and 41 and biasing spring 42 are all positioned within the hollow interior of valve body 43 which in turn is positioned within valve bore 44 of structural member 45. The valve body 43 remains stationary within valve bore 44. Overhead passageway 47 is the means through which oil is delivered to the solenoid valve and aperture 48 supplies the delivered oil to branch passageway 26.

The actual solenoid valve mechanism includes the two check valve pins and the biasing spring all of which are positioned within the disclosed housing. The two check valve pins are in axial alignment with each other and the biasing spring tends to bias or push apart the two pins, in opposite directions. However, when the solenoid armature 39 is extended, the distance between the end of that armature and the inlet edge 47*a* of overhead passageway 47 is not sufficient to allow the upper and lower check valve pins to separate. In this particular configuration, they appear as a solid member and the overhead passageway 47 is sealed closed. The upper portion of the valve body 43 around pin 40 provides a return oil path for the high pressure circuit oil to drain back to the engine when the engine retarder braking system is not activated or energized.

It is possible for the solenoid 36 to be thought of as part of the solenoid valve 20 since some type of control mechanism is required to act on the upper check valve pin 40. However, since such a solenoid is included as part of earlier engine retarder systems, and the changes provided by the present invention focus on the construction of valve 20, the "boundary" for valve 20 should be drawn to include the housing 43, the two check valve pins 40, 41, and the biasing spring 42.

There is a low pressure supply of oil present at passageway 47 whenever the engine is operating. Whether or not oil will actually be delivered to the high pressure circuit via passageway 26 depends on the pressure level in that high pressure circuit. Whenever the low pressure level of the oil supply is sufficient to overcome the spring bias force of spring 42, and whatever opposing pressure may be present in the high pressure circuit, lower check valve pin 41 is lifted and the low pressure supply of oil is allowed to flow into and fill the high pressure circuit. Obviously as the high pressure circuit fills with oil, there is an exerted back pressure which, in combination with the biasing spring 42, will at some point override the entering oil pressure and return the lower check valve pin 41 to its sealed position against the entrance 47*a* of passageway 47 which is part of the valve body or housing 43.

Figure 2:
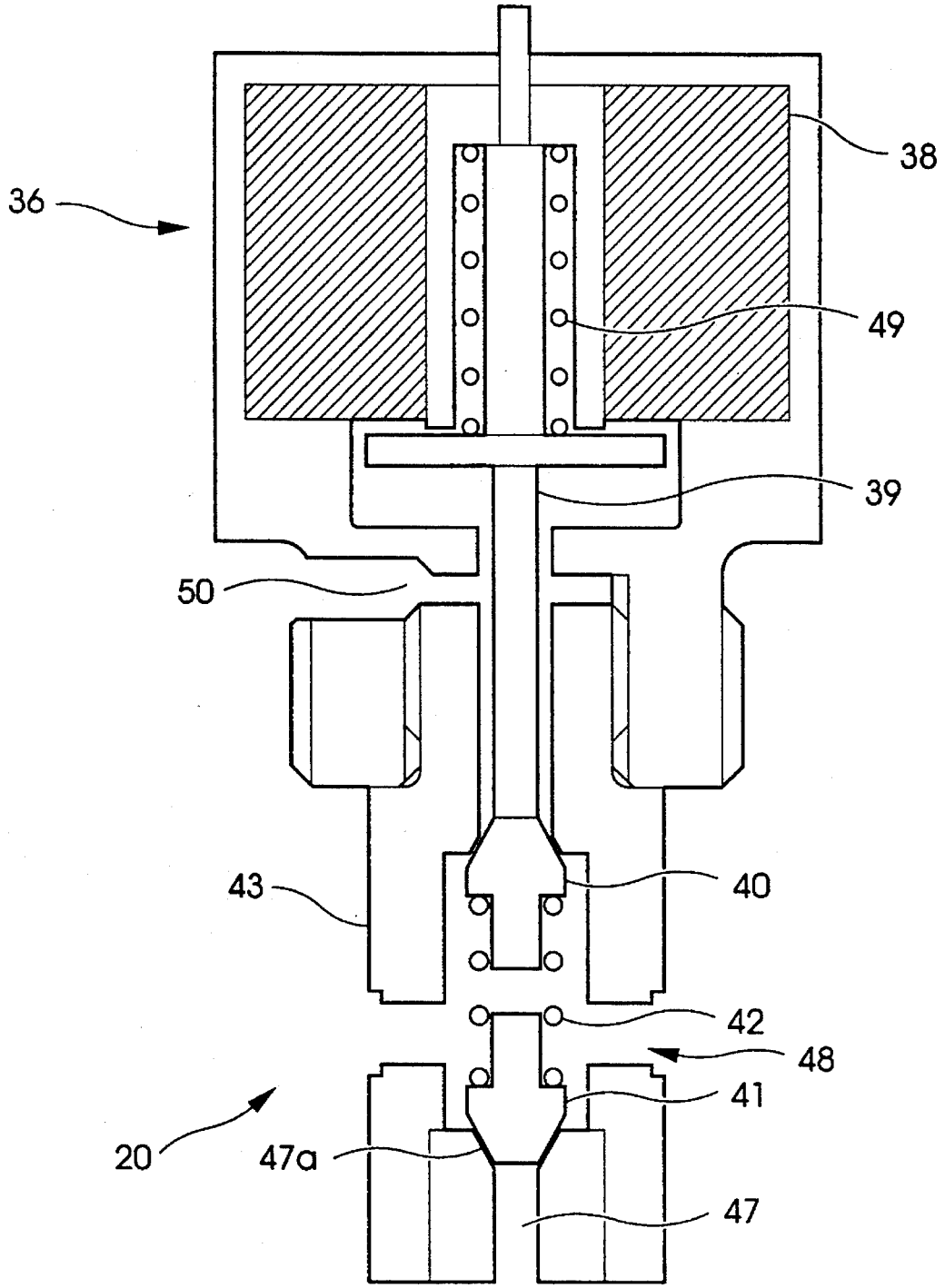
FIG. 2 is an enlarged diagrammatic, front elevational view of the FIG. 1 solenoid valve.

The detailed specifics of the structure of solenoid valve 20 are illustrated in FIG. 2. In this detailed illustration, the solenoid 36 is included and as mentioned above, the solenoid 36 can be thought of as part of the solenoid valve or as a separate component, though here it is treated as a separate component which simply has a position and operational relationship to solenoid valve 20 with regard to control of the position of the upper check valve pin 40. In addition to what was illustrated in FIG. 1, solenoid 36 includes a bias spring 49 and the valve body 43 provides a leakage escape path defined by clearance space 50 for the return of oil in the high pressure circuit back to the engine.

Figure 4:
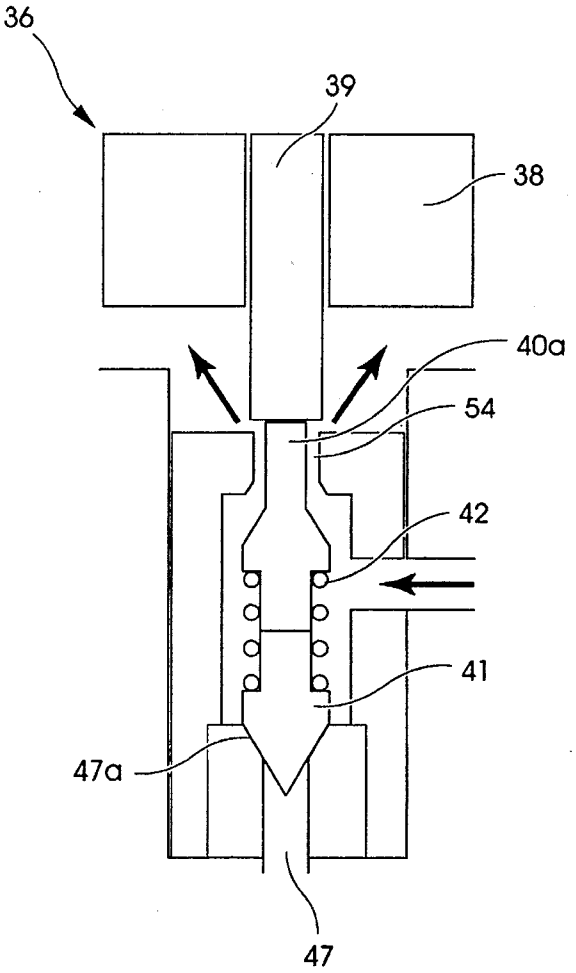
FIG. 4 is a diagrammatic illustration of the FIG. 1 solenoid valve in combination with a solenoid when the engine retarder braking system is de-energized.
Figure 5:
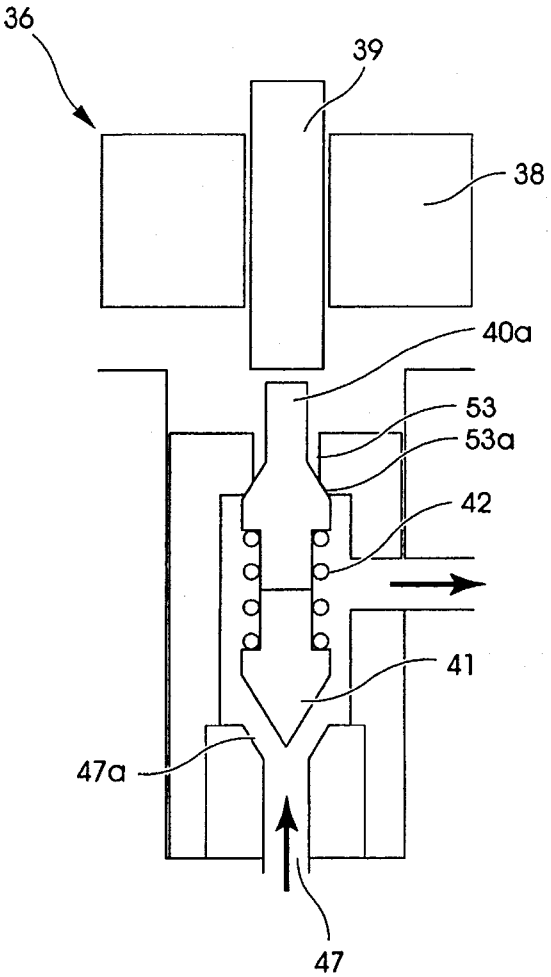
FIG. 5 is a diagrammatic illustration of the FIG. 1 solenoid valve in combination with a solenoid when the oil inlet is open so as to fill the high pressure circuit.
Figure 3:
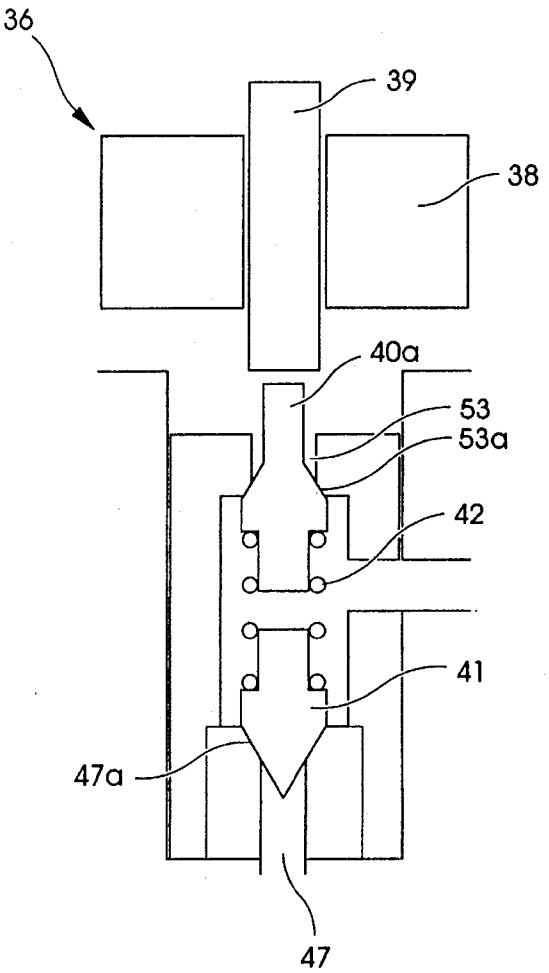
FIG. 3 is a diagrammatic illustration of the FIG. 1 solenoid valve in combination with a solenoid when the engine retarder braking system is activated and a corresponding high pressure circuit is sealed closed.

The stages off operation of the engine retarder braking system 10 including solenoid valve 20, as the engine retarder system is activated and de-activated, are illustrated in FIGS. 3, 4, and 5. If we start with the condition or assumption that the high pressure circuit is filled with oil, this will in turn mean that the solenoid coil has been energized and that pin 41 is sealed closed against inlet edge 47*a* (see FIG. 3). Energizing of solenoid coil 38 causes the solenoid armature 39 to retract or, based upon the orientation of FIG. 3, to move in an upward direction away from the upper stem portion 40*a* of upper check valve pin 40. The retraction of the armature releases the upper check valve pin 40 such that the separation or biasing force exerted by spring 42 is now able to actually move the upper check valve pin in an upward direction such that the body of the pin engages the inside edge 53*a* of armature access port 53 and thereby precludes the flow through or back flow of any oil to the engine.

The assumption made with regard to the illustration of FIG. 3 is that the high pressure circuit was initially filled with oil. As a consequence, there is sufficient opposing pressure (in combination with biasing spring 42) to prevent any upward movement of the lower check valve pin 41. The result is that the high pressure circuit is completely sealed closed, trapping in the various cylinders and passageways a volume of oil which has no means to escape. Sealing of the high pressure circuit is also accomplished at the interface between the valve body 43 and the valve bore 44 using a precision fit. This type of precision fit also exists between the master cylinder 21 and master piston 22 as well as between the slave cylinder 23 and slave piston 24.

With the high pressure circuit closed and sealed, upward movement of the injector push rod 29 in combination with the rocker arm adjusting screw 30 pushes upwardly on the master piston 22. As the master piston moves in an upward direction, the pressure is increased on the oil which fills the high pressure circuit. The increase in oil pressure completes any sealing of the circuit by providing the necessary pressure difference to prevent the low pressure supply from lifting check valve pin 41. The movement of the master piston and the corresponding increase in the oil pressure acts against the slave piston 24 which is then moved in a downward direction. As the slave piston 24 is pushed down against the crosshead 33, the opposing spring force is overcome and exhaust valves 31 and 32 for that particular cylinder are opened. As previously explained, the valves are opened when the piston is near TDC, on the compression stroke, allowing the compressed air to escape from the cylinder. This effectively cancels the power stroke and creates the desired braking effect.

At the end of this first compression braking cycle, the injector push rod and master piston travel downward, allowing the oil pressure in the oil circuit to return to normal. The immediate consequence is for the slave piston to move upward, allowing the exhaust valves 31 and 32 to close.

When the engine retarder braking system is de-activated (see FIG. 4), the solenoid armature 39 is in contact with the upper check valve pin 40. Actually the portion which contacts the armature is the stem extension 40*a* which extends up through armature access port 53 such that the upper end of stem 40*a* actually extends out of valve body (housing) 43. The diameter size of extension 40*a* relative to the size of the access port is such that an annular clearance space 54 is left for flow communication between passageway 26 and clearance space 50. Although not believed to be the preferred embodiment, it would be possible to modify the shape of armature 39 and correspondingly change the shape of upper check valve pin 40 such that a portion of the armature could actually extend through port 53 in order to act upon pin 40.

In the FIG. 4 illustration, the oil supply which is present at overhead passageway 47 applies pressure on the lower check valve pin 41. However, pin 41 which is axially aligned with pin 40, remains closed against the housing entrance 47*a* of passageway 47 due to the force applied from the solenoid bias spring 49 via armature 39 and upper check valve pin 40. Regardless of any pressure differences between the high pressure circuit and the low pressure supply, lower check valve pin 40 remains closed and sealed against the entrance of passageway 47 when the brake is off. In this arrangement, oil is not allowed to enter and fill the high pressure circuit. Also during the solenoid valve de-activation (brake off), there is a leakage path created by clearance space 50 in combination with annular clearance space 54 and passageway 26 for oil to escape from the high pressure circuit and return to the engine.

The final stage to be discussed which is actually the initializing step in the overall process is the step of filling the high pressure circuit with oil and this is illustrated in FIG. 5. The high pressure circuit is filled with oil during initial activation and is refilled with oil during each cycle. For this brake-fill stage or the stage which initializes the system by filling the high pressure circuit with oil, all of the internal components of the solenoid valve are in the same configuration as in the brake activated stage of FIG. 3. The only exception is that the lower check valve pin 40 is pushed up out of sealing engagement against the housing entrance 47*a* of passageway 47.

In the FIG. 5 illustration, the solenoid coil 38 is energized and the armature 39 is pulled up and away from the upper check valve pin 40. The assumption made for this illustration is that the high pressure circuit is at a pressure level below the pressure level of the incoming oil supply. This is what would be expected, since the incoming oil supply will be at a pressure level at something above atmospheric pressure and at this point, the high pressure circuit or at least the unfilled portion of it, is at atmospheric pressure. Further, the pressure level of the incoming oil supply is greater or exerts a greater force than the opposing force on the lower check valve pin 41 exerted by spring 42. Through a simple force balance typical to conventional check valve design, the lower check valve pin 41 comes out of its sealed engagement and this allows the flow of low pressure oil to enter the housing. From the housing the oil is routed via passageway 26 to the high pressure circuit. This arrangement allows the high pressure circuit to fill with oil during the initial activation and then refill during each cycle. The repeating steps of the oil filling the high pressure circuit with each cycle is governed by the pressure and force differences and no other controls are required.

The solenoid valve 20 of the present invention provides a unique and compact single component design which can be readily adapted to an engine retarder braking system. The engine retarder breaking system still includes the master piston and cylinder as well as the slave piston and cylinder and the connecting passageway between the two as part of the high pressure circuit. The system also includes a solenoid, but otherwise the solenoid valve and control valve functions of earlier designs are combined into a unique arrangement which provides greater reliability and a more compact size. There are, in effect, only three components to deal with in the sense of the solenoid valve, ignoring for now the specific size, shape, and configuration of the valve body or housing. The three components are simply the upper check valve pin, the lower check valve pin, and the separating or biasing spring disposed around and between those two members. The simplicity of this design which can handle both low pressure flow in a very precise and reliable manner as well as the high pressure circuit results in a very desireable invention which is novel and unobvious.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A solenoid valve for use with a solenoid as part of an engine retarder braking system, said solenoid including a coil and moveable armature, said braking system including a high pressure circuit with a master piston disposed within a master cylinder, a slave piston disposed within a slave cylinder, and a flow passageway connecting the master cylinder with the slave cylinder, said solenoid valve comprising:

a housing arranged with a fluid inlet, a fluid outlet which is flow coupled to said flow passageway, and an armature access port, said housing further defining a hollow interior;

an upper check valve pin positioned within said hollow interior and which is designed to seal closed said armature access port, and which is moveable between an access port sealed position and an access port opened position;

a lower check valve pin positioned within said hollow interior and which is designed to seal closed said fluid inlet and which is moveable between a fluid inlet sealed position and a fluid inlet opened position; and a biasing spring disposed within said hollow interior and which is positioned relative to said upper and lower check valve pins so as to apply a separating spring force to bias said upper and lower check valve pins in opposite directions apart from each other, wherein when the armature is retracted the upper check valve pin seals closed the access port and when the fluid pressure at the fluid inlet is able to push the lower check valve pin out of sealed engagement, fluid fills the high pressure circuit, and with both check valve pins in a sealed condition the fluid is trapped in the high pressure circuit and the master piston is able to move the slave piston for opening corresponding exhaust valves.

2. The solenoid valve of claim 1 wherein said upper check valve pin includes a stem portion extending through said access port.

3. The solenoid valve of claim 2 wherein the size of said stem portion relative to said access port leaves an escape path clearance around said stem portion.

4. The solenoid valve of claim 3 wherein said access port is located at a first end of said housing, said fluid inlet is located at a second end of said housing which is oppositely disposed from said first end, and said fluid outlet is located intermediate between said access port and said fluid inlet.

5. The solenoid valve of claim 1 wherein said access port is located at a first end of said housing, said fluid inlet is located at a second end of said housing which is oppositely disposed from said first end, and said fluid outlet is located intermediate between said access port and said fluid inlet.

6. A solenoid valve for use with a solenoid as part of an engine retarder braking system, said solenoid valve comprising:

a valve body having a fluid inlet, a fluid outlet, and an access port;

a first valve pin disposed within said valve body and designed to seal closed said access port when forced into engagement therewith;

a second valve pin disposed within said valve body and designed to seal closed said fluid inlet when forced into engagement therewith; and a separating spring disposed within said valve body and arranged between said first and second valve pins so as to spring bias and urge said first valve pin away from said second valve pin and towards said access port and so as to concurrently spring bias and urge said second valve pin away from said first valve pin and toward said fluid inlet, wherein the sealing closed of said access port and of said fluid inlet creates a closed high pressure circuit which is in fluid communication with said fluid outlet.

7. The solenoid valve of claim 6 wherein said first valve pin includes a stem portion extending through said access port.

8. The solenoid valve of claim 7 wherein the size of said stem portion relative to said access port leaves an escape path clearance around said stem portion.

9. The solenoid valve of claim 8 wherein said access port is located at a first end of said valve body, said fluid inlet is located at a second end of said valve body which is oppositely disposed from said first end, and said fluid outlet is located intermediate between said access port and said fluid inlet.

10. The solenoid valve of claim 6 wherein said access port is located at a first end of said valve body, said fluid inlet is located at a second end of said valve body which is oppositely disposed from said first end, and said fluid outlet is located intermediate between said access port and said fluid inlet.

11. An engine retarder braking system comprising:

a solenoid having a coil and moveable armature;

a master piston disposed within a master cylinder;

a slave piston disposed within a slave cylinder;

a first fluid conduit connecting said master cylinder and said slave cylinder;

a solenoid valve including:

a housing arranged with a fluid inlet, a fluid outlet which is flow coupled to said flow passageway, and an armature access pork, said housing further defining a hollow interior;

an upper check valve pin positioned within said hollow interior and which is designed to seal closed said armature access port, and which is moveable between an access port sealed position and an access port opened position;

a lower check valve pin positioned within said hollow interior and which is designed to seal closed said fluid inlet and which is moveable between a fluid inlet sealed position and a fluid inlet opened position; and a biasing spring disposed within said hollow interior and which is positioned relative to said upper and lower check valve pins so as to apply a separating spring force to bias said upper and lower check valve pins in opposite directions apart from each other, wherein when the armature is retracted the upper check valve pin seals closed the access port and when the fluid pressure at the fluid inlet is able to push the lower check valve pin out of sealed engagement, fluid fills the master cylinder, slave cylinder and first fluid conduit, and with both check valve pins in a sealed condition the fluid is trapped in a high pressure circuit defined by said master cylinder, slave cylinder and first fluid conduit, and the master piston is able to move the slave piston for opening corresponding exhaust valves; and a second fluid conduit connecting said fluid outlet with said first fluid conduit.

12. The engine retarder braking system of claim 11 wherein said upper check valve pin includes a stem portion extending through said access port.

13. The engine retarder braking system of claim 12 wherein the size of said stem portion relative to said access port leaves an escape path clearance around said stem portion.

14. The engine retarder braking system of claim 13 wherein said access port is located at a first end of said housing, said fluid inlet is located at a second end of said housing which is oppositely disposed from said first end, and said fluid outlet is located intermediate between said access port and said fluid inlet.

15. An engine retarder braking system comprising:

a solenoid having a coil and moveable armature;

a master piston disposed within a master cylinder;

a slave piston disposed within a slave cylinder;

a fluid conduit connecting said master cylinder and said slave cylinder; and a solenoid valve including:

a valve body having a fluid inlet, a fluid outlet, and an access port;

a first valve pin disposed within said valve body and designed to seal closed said access port when forced into engagement therewith;

a second valve pin disposed within said valve body and designed to seal closed said fluid inlet when forced into engagement therewith; and a separating spring disposed within said valve body and arranged between said first and second valve pins so as to spring bias and urge said first valve pin away from said second valve pin and towards said access port and so as to concurrently spring bias and urge said second valve pin away from said first valve pin and toward said fluid inlet, wherein the sealing closed of said access port and of said fluid inlet creates a closed high pressure circuit which is in fluid communication with said fluid outlet.

16. The engine retarder braking system of claim 15 wherein said first valve pin includes a stem portion extending through said access port.

17. The engine retarder braking system of claim 16 wherein the size of said stem portion relative to said access port leaves an escape path clearance around said stem portion.

18. The engine retarder braking system of claim 17 wherein said access port is located at a first end of said valve body, said fluid inlet is located at a second end of said valve body which is oppositely disposed from said first end, and said fluid outlet is located intermediate between said access port and said fluid inlet.

* * * * *

UNITED STATES PATENT AND TRADEMARK OFFICE
CERTIFICATE OF CORRECTION

PATENT NO. : 5,477,824

DATED : Dec. 26, 1995

INVENTOR(S) : Steven W. Reedy

It is certified that error appears in the above-identified patent and that said Letters Patent is hereby corrected as shown below:

Title page, item [57], (Abstract) in line 1, replace "park" with --part--.

In Col. 4, at line 39, replace "masher" with --master--.

In Col. 5, at line 55, replace "off" with --of--.

In Col. 9, at line 35, replace "pork" with --port--.

Signed and Sealed this

Seventeenth Day of December, 1996

*Attest:*

Bruce Lehman

BRUCE LEHMAN

*Attesting Officer*

*Commissioner of Patents and Trademarks*